US011160332B2

(12) United States Patent
Kuo et al.

(10) Patent No.: US 11,160,332 B2
(45) Date of Patent: Nov. 2, 2021

(54) BUCKLE

(71) Applicant: IMMENSE PROSPEROUS ENTERPRISE CO., LTD., New Taipei (TW)

(72) Inventors: Chien-Tsung Kuo, New Taipei (TW); Sheng-Jo Kuo, New Taipei (TW)

(73) Assignee: IMMENSE PROSPEROUS ENTERPRISE CO., LTD., New Taipei (TW)

( * ) Notice: Subject to any disclaimer, the term of this patent is extended or adjusted under 35 U.S.C. 154(b) by 16 days.

(21) Appl. No.: 16/827,543

(22) Filed: Mar. 23, 2020

(65) Prior Publication Data

US 2020/0329825 A1 Oct. 22, 2020

(30) Foreign Application Priority Data

Apr. 17, 2019 (TW) ..... 108204712

(51) Int. Cl.
*A44B 11/25* (2006.01)
*A44B 11/28* (2006.01)
*A44B 11/26* (2006.01)

(52) U.S. Cl.
CPC ..... *A44B 11/28* (2013.01); *A44B 11/266* (2013.01); *A44B 11/26* (2013.01); *Y10T 24/45194* (2015.01); *Y10T 24/45529* (2015.01)

(58) Field of Classification Search
CPC ..... Y10T 24/45152; Y10T 24/45173; Y10T 24/45183; Y10T 24/45194; Y10T 24/4522; Y10T 24/45215; A44B 11/266; A44B 11/2592; A44D 2200/12
See application file for complete search history.

(56) References Cited

U.S. PATENT DOCUMENTS 4,569,106 A * 2/1986 Lovato ..... A44B 11/266 24/615
4,621,393 A * 11/1986 Ambal ..... A44B 11/266 24/171
4,779,315 A * 10/1988 Kohus ..... A44B 11/266 24/587.12
5,735,024 A * 4/1998 Ortiz ..... A44B 11/266 24/573.11
9,578,931 B2 * 2/2017 Osterberg ..... A44B 11/2561
9,730,495 B2 * 8/2017 Howell ..... A44B 11/266
2003/0121129 A1 * 7/2003 Hamilton ..... A44B 11/266 24/615

(Continued)

*Primary Examiner* — Robert Sandy
*Assistant Examiner* — Michael S Lee
(74) *Attorney, Agent, or Firm* — Hamre, Schumann, Mueller & Larson, P.C.

(57) ABSTRACT

A buckle includes two coupling modules coupled separably to each other. Each of the coupling modules includes a main unit including a hook member and a coupling member that has a retaining portion, and an operating member having an operating portion and a pushing portion. The hook member of each of the coupling modules is engaged with the retaining portion of the other one of the coupling modules. The operating portions of the operating members of the coupling modules are movable toward each other, during which the pushing portion of each of the coupling modules pushes the hook member of the other one of the coupling modules to disengage said hook member from the retaining portion of the coupling module.

11 Claims, 10 Drawing Sheets

(56) References Cited

U.S. PATENT DOCUMENTS

| | | | | |
|---|---|---|---|---|
| 2003/0182772 | A1* | 10/2003 | Austin | A44B 11/2592 24/312 |
| 2009/0119890 | A1* | 5/2009 | Laruccia | A45C 13/1084 24/586.1 |
| 2011/0193396 | A1* | 8/2011 | Friedman | B60R 22/36 297/484 |
| 2013/0011179 | A1* | 1/2013 | Fiedler | A45C 13/10 403/49 |
| 2013/0333634 | A1* | 12/2013 | Rosenquist | A44B 11/263 119/865 |
| 2016/0360839 | A1* | 12/2016 | Baumann | A44B 11/266 |

* cited by examiner

BUCKLE

CROSS-REFERENCE TO RELATED APPLICATION

This application claims priority of Taiwanese Utility Model Patent Application No. 108204712, filed on Apr. 17, 2019.

FIELD

The disclosure relates to buckle, more particularly to a buckle for connecting two straps.

BACKGROUND

A backpack often has at least one buckle for connecting two straps. The mechanism of the buckle allows a user to secure the backpack to himself or to open and close the backpack with ease.

A conventional buckle includes a male connector and a female connector. In order for the male and female connectors to couple with each other, the female connector may have a groove, and the male connector may have an elastic hook engaged separably to the groove. The conventional buckle may be separated by pressing the elastic hook directly to disengage the elastic hook from the groove, or may have an unlocked button formed on the female connector for disengaging the elastic hook.

Since the male and female connectors of the conventional buckle has different structures, they must be manufactured separately, which results in a relative high production cost.

SUMMARY

Therefore, the object of the disclosure is to provide a buckle that can alleviate the drawback of the abovementioned prior art.

According to the disclosure, a buckle includes two coupling modules coupled separably to each other. Each of the coupling modules includes a main unit, an operating member, and a resilient member that is connected between the main unit and the operating member.

For each of the coupling modules, the main unit includes a base seat being elongated in a length direction and having a seat portion, a hook member connected to the seat portion of the base seat, and a coupling member connected to the seat portion of the base seat and having a coupling groove and a retaining portion. The hook member and the coupling member are spaced apart in the length direction. The hook member of each of the coupling modules extends into the coupling groove of the other one of the coupling modules and is engaged with the retaining portion of the other one of the coupling modules.

For each of the coupling modules, the operating member is connected removably to the main unit, and has an operating portion that is adjacent to the coupling member of the main unit, and a pushing portion that is adjacent to the retaining portion of the coupling member.

The operating portions of the operating members of the coupling modules are movable substantially parallel to the length direction toward each other relative to the main units of the coupling modules against resilient forces of the resilient members of the coupling modules from a standby state to an unlocked state, during which the pushing portion of the operating member of each of the coupling modules pushes the hook member of the main unit of the other one of the coupling modules to disengage the hook member from the retaining portion of the coupling member of the main unit of the coupling module, thereby permitting separation of the coupling modules from each other.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
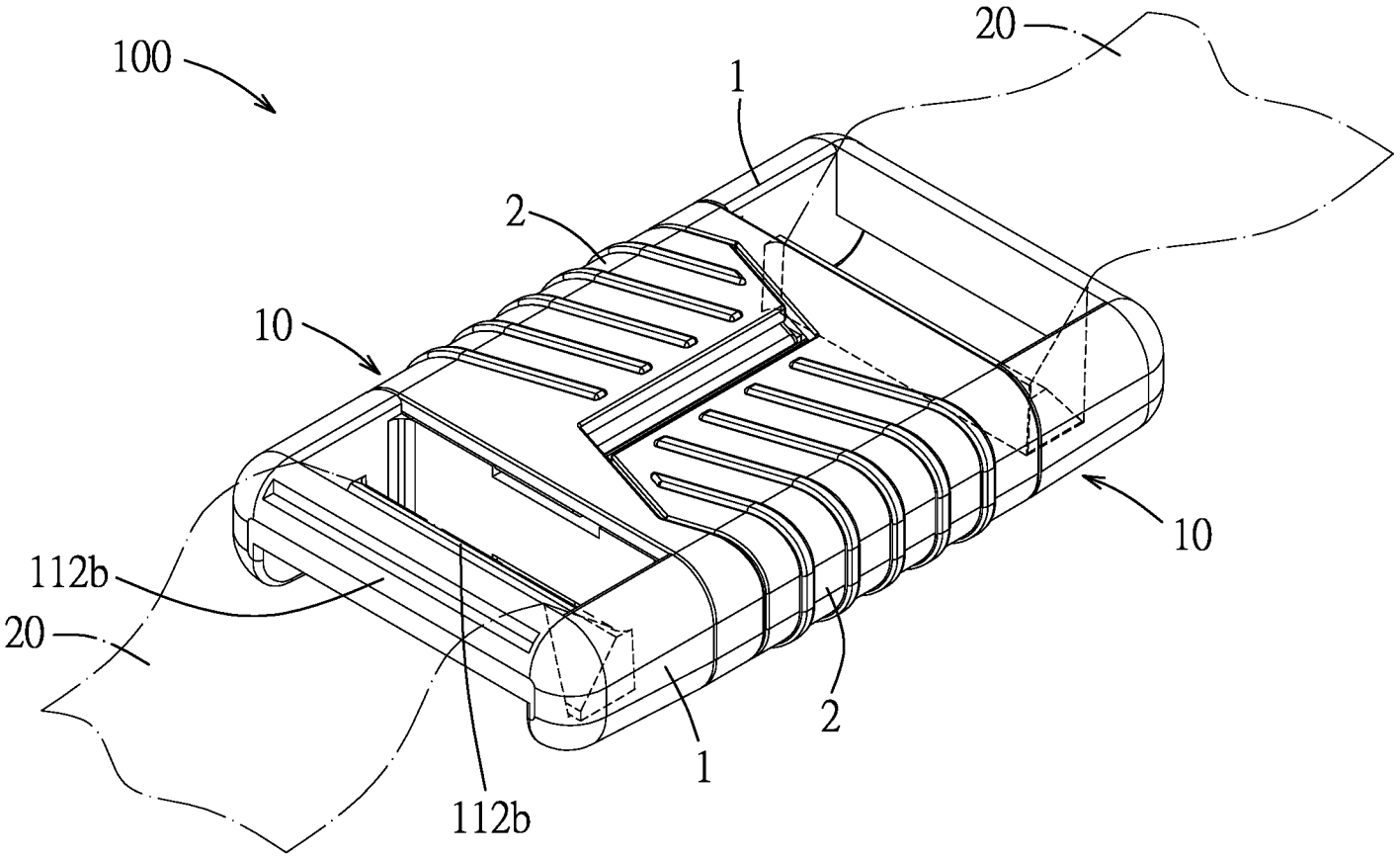
FIG. 1 is a perspective view of an embodiment of a buckle according to the disclosure.
Figure 2:
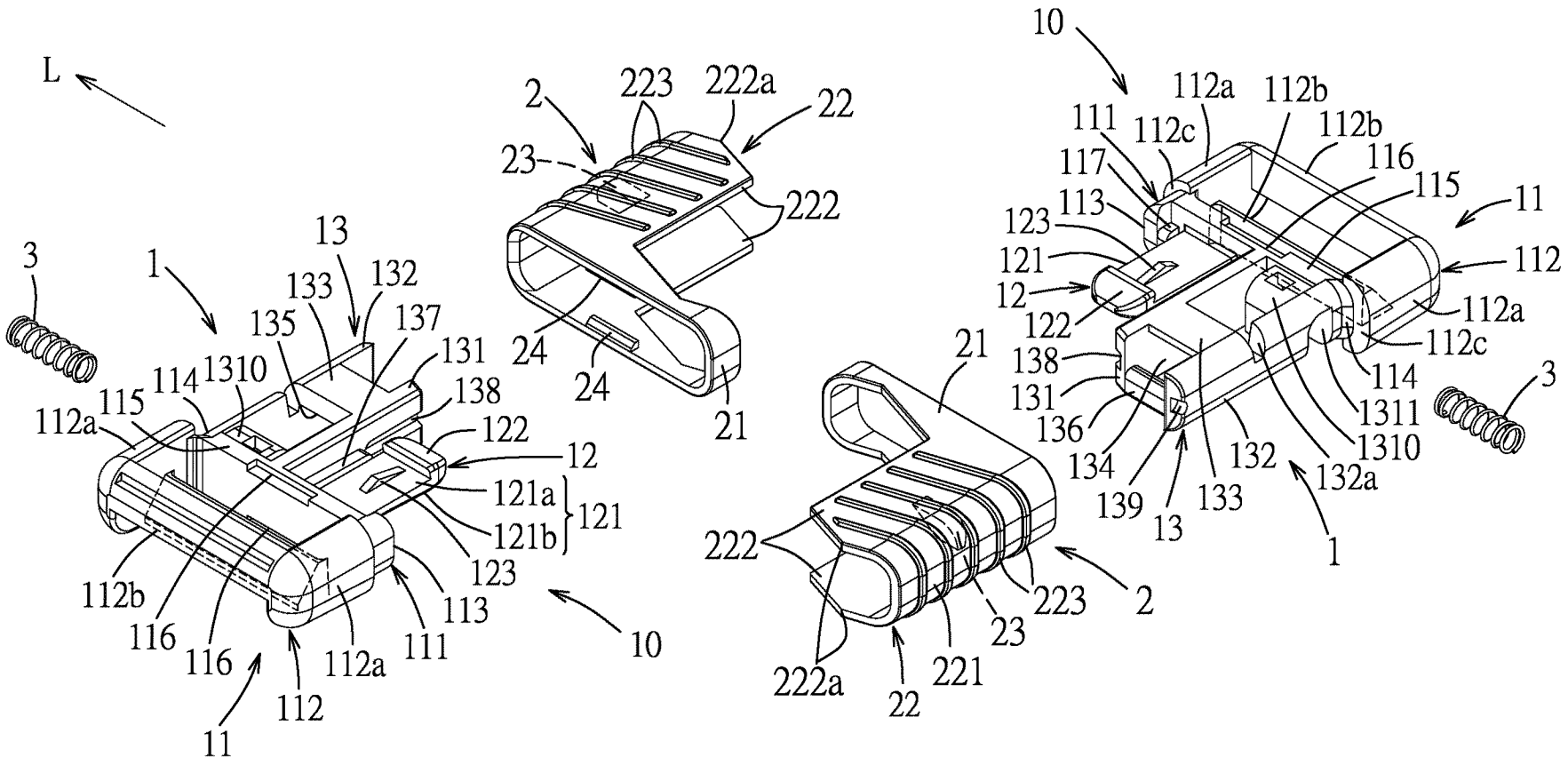
FIG. 2 is an exploded perspective view of the embodiment.
Figure 3:
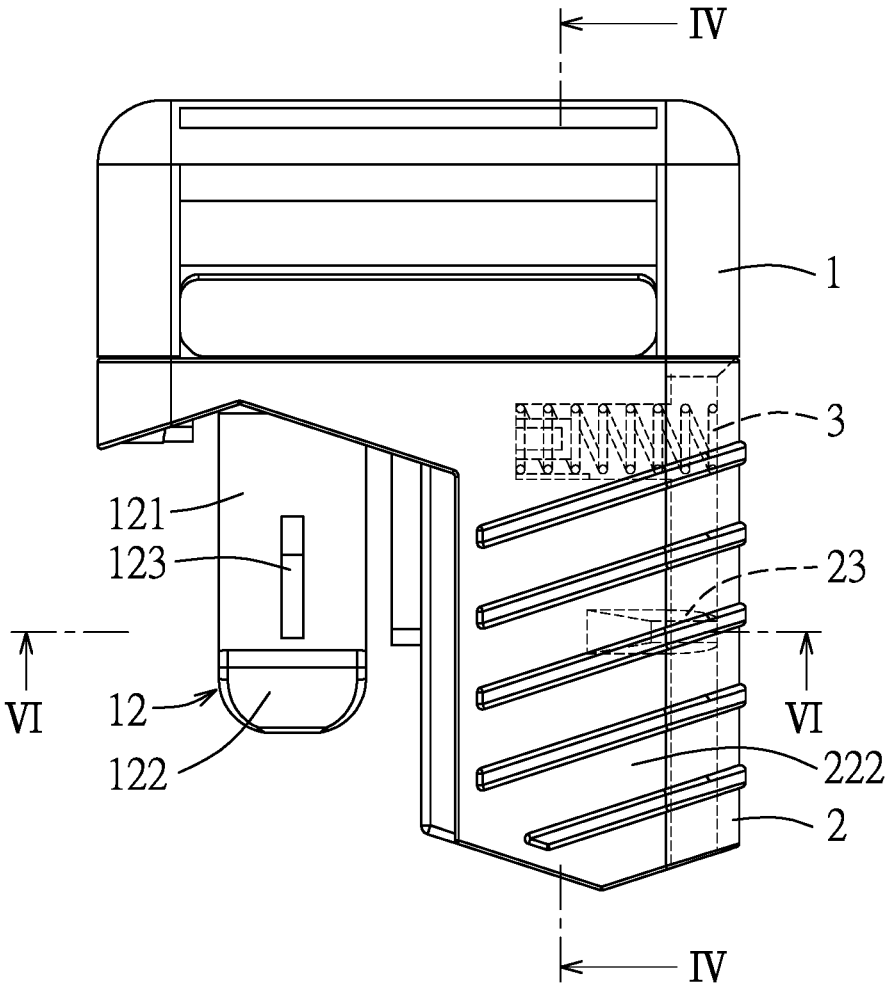
FIG. 3 is a side view of a coupling module of the embodiment.

Referring to FIGS. 1, 2 and 3, an embodiment of a buckle 100 is for interconnecting two straps 20 and includes two coupling modules 10 having identical features, which allows production cost of the buckle 100 to be reduced. In the following description, only one of the coupling modules 10 is referred to for the sake of brevity.

The coupling module 10 includes a main unit 1, an operating member 2 connected removably to the main unit 1, and a resilient member 3 connected between the main unit 1 and the operating member 2.

The main unit 1 includes a base seat 11 being elongated in a length direction (L), a hook member 12 connected to the base seat 11, and a coupling member 13 connected to the base seat 11 and spaced apart from the hook member 12 in the length direction (L).

The base seat 11 has a seat portion 111 and a strap-connecting portion 112 connected to the seat portion 111. The seat portion 111 has first and second short surfaces 113, 114 opposite in the length direction (L), two opposite long surfaces 115 (see FIG. 4) extending in the length direction (L) and interconnecting the first and second short surfaces 113, 114. Each of the long surfaces 115 is formed with a limiting groove 116 extending in the length direction (L). The base seat 11 further has a positioning rib 117 protruding from the seat portion 111. The first and second short surfaces 113, 114 are respectively proximal to the hook member 12 and the coupling member 13. The positioning rib 117 is disposed at a side of the hook member 12 which is opposite to the coupling member 13 in the length direction (L).

The strap-connecting portion 112 has two side walls 112*a* spaced apart from each other in the length direction (L), and two spaced-apart rods 112*b* interconnecting the side walls 112*a*. Each of the side walls 112*a* has a contact surface 112*c* connected to a respective one of the first and second short surfaces 113, 114 of the seat portion 111. A distance in the length direction (L) between outer ends of the contact surfaces 112*c* of the side walls 112*a* is larger than that between the first and second short surfaces 113, 114. The contact surface 112*c* of the one of the side walls 112*a* which is connected to the first short surface 113 of the seat portion 111 of the base seat 11 has a smaller area than that of the contact surface 112*c* of the other one of the side walls 112*a*. The rods 112*b* are for a corresponding one of the straps 20 to wrap around and be secured to.

The hook member 12 has an elastic arm 121 extending from the seat portion 111 of the base seat 11, a hook portion 122 connected to an end portion of the elastic arm 121 which is distal from the seat portion 111 of the base seat 11, and an abutting block 123 connected to the elastic arm 121. The elastic arm 121 has a flat shape and has opposite first and second arm surfaces 121*a*, 121*b*. The hook portion 122 and the abutting block 123 both protrude from the first arm surface 121*a*.

The coupling member 13 has an inner wall 131, an outer wall 132 formed with a passage 132*a*, a connecting wall 133 interconnecting the inner wall 131 and the outer wall 132, a limiting wall 136 interconnecting the inner wall 131 and the outer wall 132, a guiding rib 137 and a guiding groove 138 proximate to the hook member 12, an positioning groove 139 formed in the outer wall 132 and having a shape that corresponds to the positioning rib 117 of the base seat 11, and a receiving portion 1310 connected to the seat portion 111 of the base seat 11 and the outer wall 132.

The inner and outer walls 131, 132 extend from the seat portion 111 of the base seat 11, are transverse to the length direction (L), and are respectively proximal to and distal from the hook member 12. The receiving portion 1310 cooperates with the outer wall 132 to define a receiving space 1311 that receives the resilient member 3.

Figure 4:
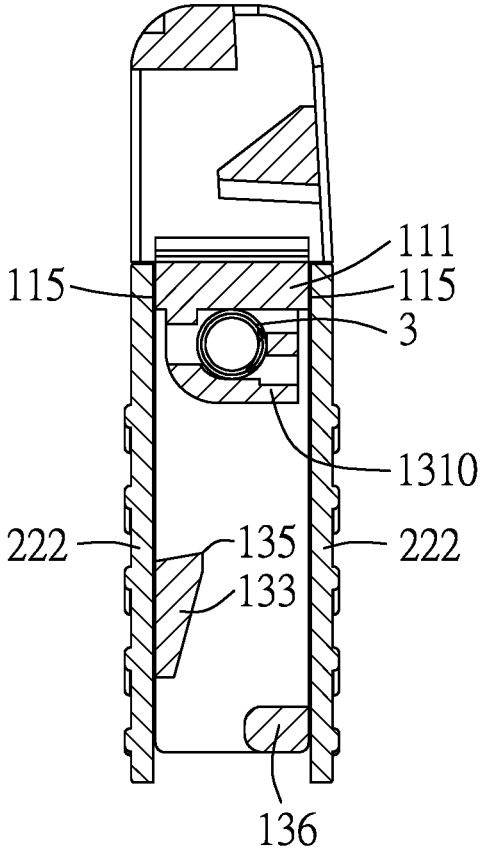
FIG. 4 is a sectional view taken along line IV-IV in FIG. 3.

The connecting wall 133 is spaced apart from the seat portion 111 of the base seat 11, is disposed between the limiting wall 136 and the seat portion 111 of the base seat 11, and cooperates with the inner and outer walls 131, 132 to define a coupling groove 134. The coupling member 13 further has a retaining portion 135. In this embodiment, the connecting wall 133 has an end that faces the seat portion 111 of the base seat 11 and that serves as the retaining portion 135. Referring to FIG. 4, in this embodiment, the thickness of the connecting wall 133 decreases in a direction away from the seat portion 111 of the base seat 11 and the retaining portion 135 has an acute-angled corner.

Figure 5:
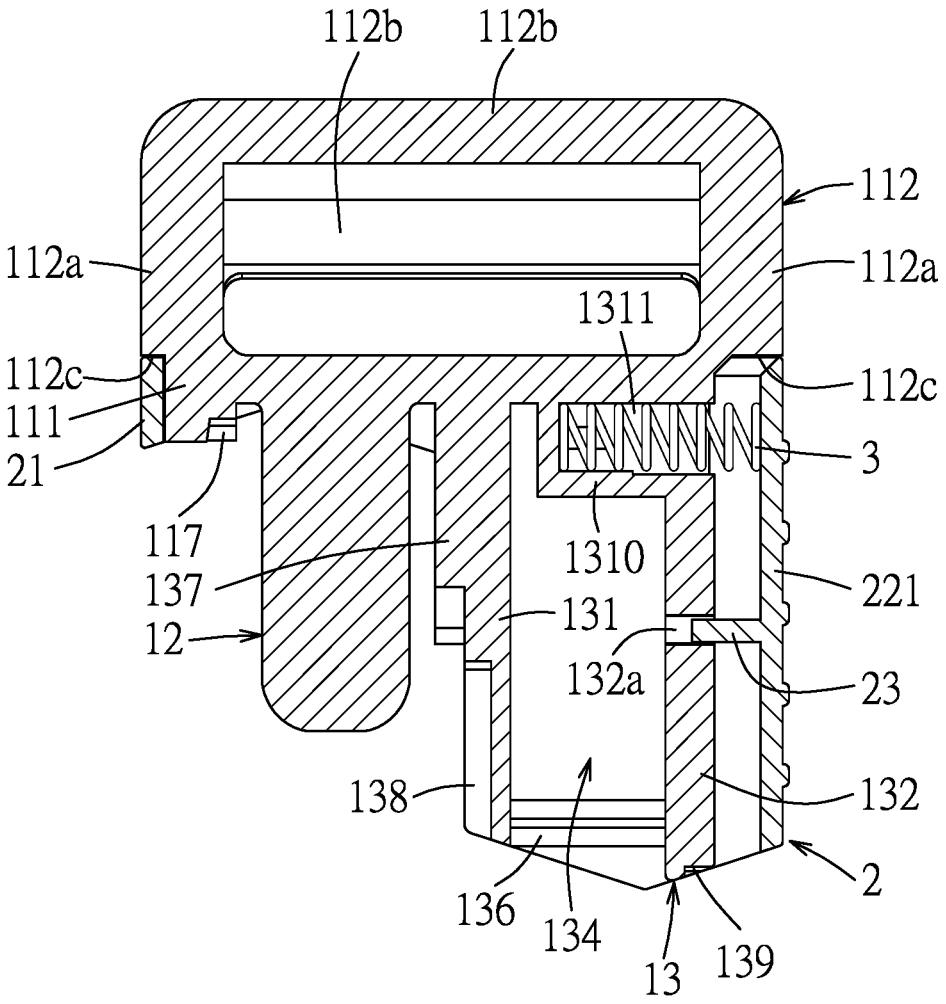
FIG. 5 is another sectional view of the coupling module.
Figure 6:
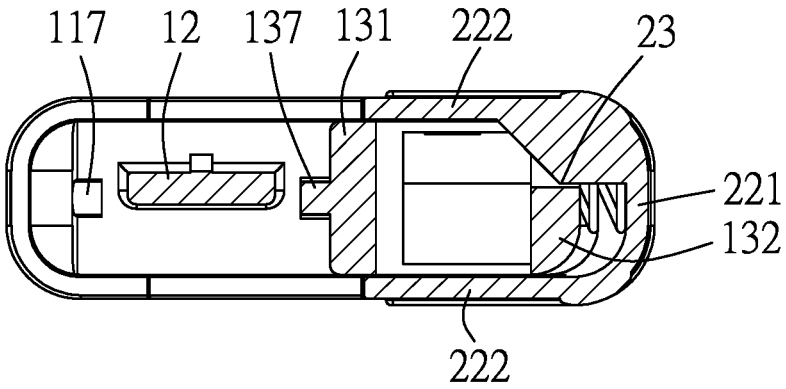
FIG. 6 is a sectional view taken along line VI-VI in FIG. 3.

Referring to FIGS. 2 and 5, the guiding rib 137 and the guiding groove 138 are respectively proximal to and distal from the seat portion 111 of the base seat 11. The guiding rib 137 protrudes from a side surface of the inner wall 131 which faces the hock member 12, and the guiding groove 138 is formed in the side surface of the inner wall 131, is collinear with the guiding rib 137, and extends through an end surface of the inner wall 131 which is opposite to the seat portion 111. Specifically, the guiding rib 137 has an end connected to the seat portion 111 of the base seat 11, and an opposite end being adjacent to the guiding groove 138. In this embodiment, the guiding rib 137 and the guiding groove 138 have substantially equal lengths which are about half of a length of the inner wall 131.

Referring to FIGS. 2, 5, 6, and 7, the operating member 2 has a surrounding portion 21 surrounding the seat portion 111 of the base seat 11, an operating portion 22 connected to the surrounding portion 21, a pushing portion 23, and two limiting blocks 24.

The surrounding portion 21 has an end portion slidably abutting against the contact surfaces 112*c* of the side walls 112*a* of the strap-connecting portion 112. The operating portion 22 is adjacent to the coupling member 13 of the main unit 1, and has a press wall 221 aligned with the outer wall 132 of the coupling member 13 in the length direction (L), two extending walls 222 respectively extending from two opposite edges of the press wall 221, and a plurality of anti-slip ribs 223. The two extending walls 222 cover the inner wall 131, the connecting wall 133 and the coupling groove 134 of the coupling member 13. The anti-slip ribs 223 are formed on outer surfaces of the press wall 221 and the extending walls 222 to improve grip of the operating portion 22.

A length of the surrounding portion 21 of the operating member 2 in the length direction (L) is larger than that of the operating portion 22. The surrounding portion 21 has an end surrounding surface surrounding the seat portion 111 of the base seat 11 and having two U-shaped half surface parts. One of the half surface parts is connected to the operating portion 22, and the other one of the half surface parts is indented. Each of the extending walls 222 of the operating portion 22 of the operating member 2 has an end surface 222*a* that is opposite to the surrounding portion 21.

The pushing portion 23 protrudes from an inner surface of the operating portion 22, is adjacent to the retaining portion 135 of the coupling member 13, and movably extends into the passage 132*a*. The limiting blocks 24 extend from an inner surface of the surrounding portion 21 and engage respectively and slidably the limiting grooves 116 of the base seat 11.

In this embodiment, the resilient member 3 is a coil compression spring that is connected between the receiving portion 1310 of the coupling member 13 and the press wall 221 of the operating member 2. In variations of this embodiment, the configuration of the resilient member 3 may vary, and the resilient member 3 and one of the main unit 1 and the operating member 2 may be molded as one piece.

Figure 7:
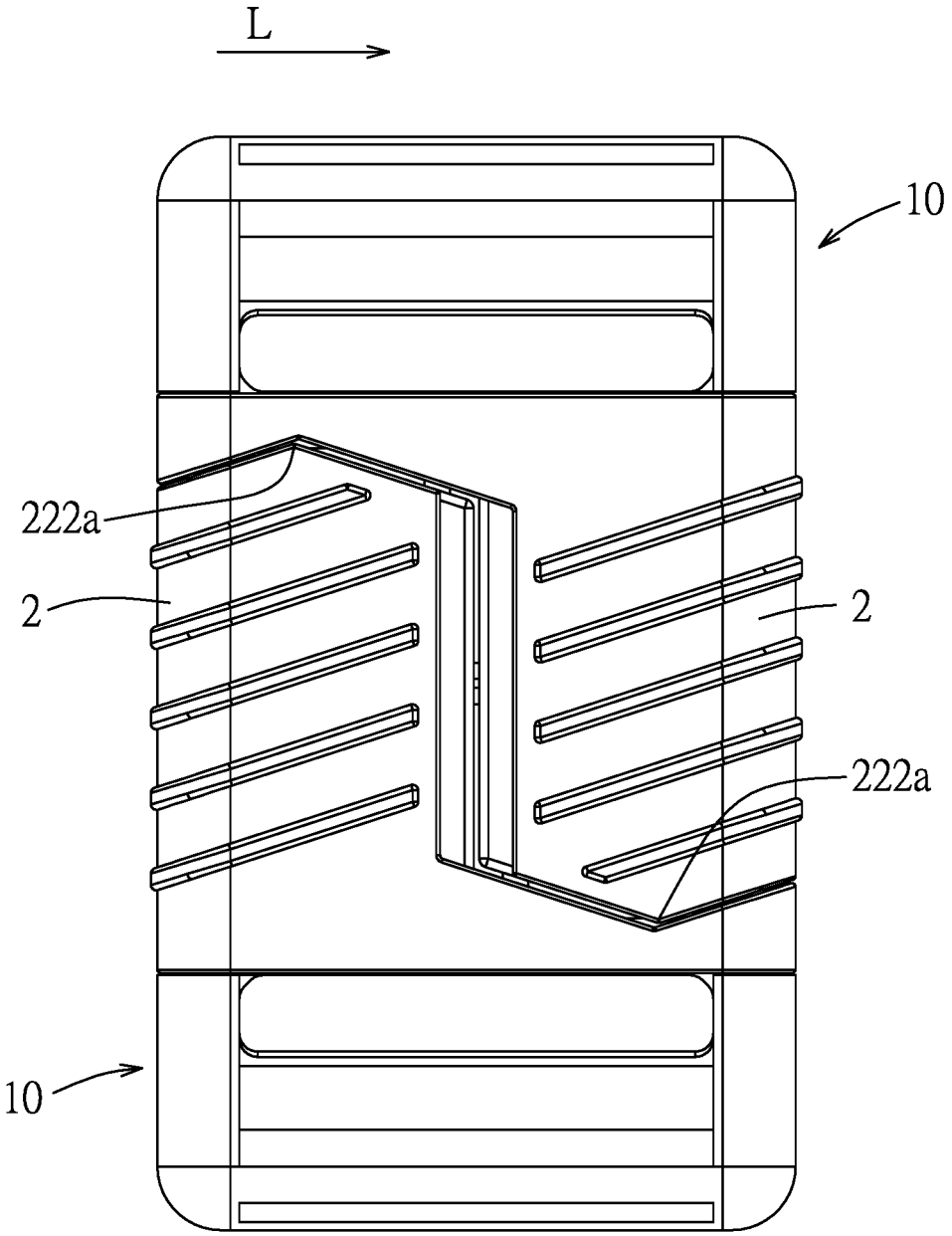
FIG. 7 is a side view of the embodiment, illustrating operating portions of operating members of two coupling modules in a standby state.
Figure 8:
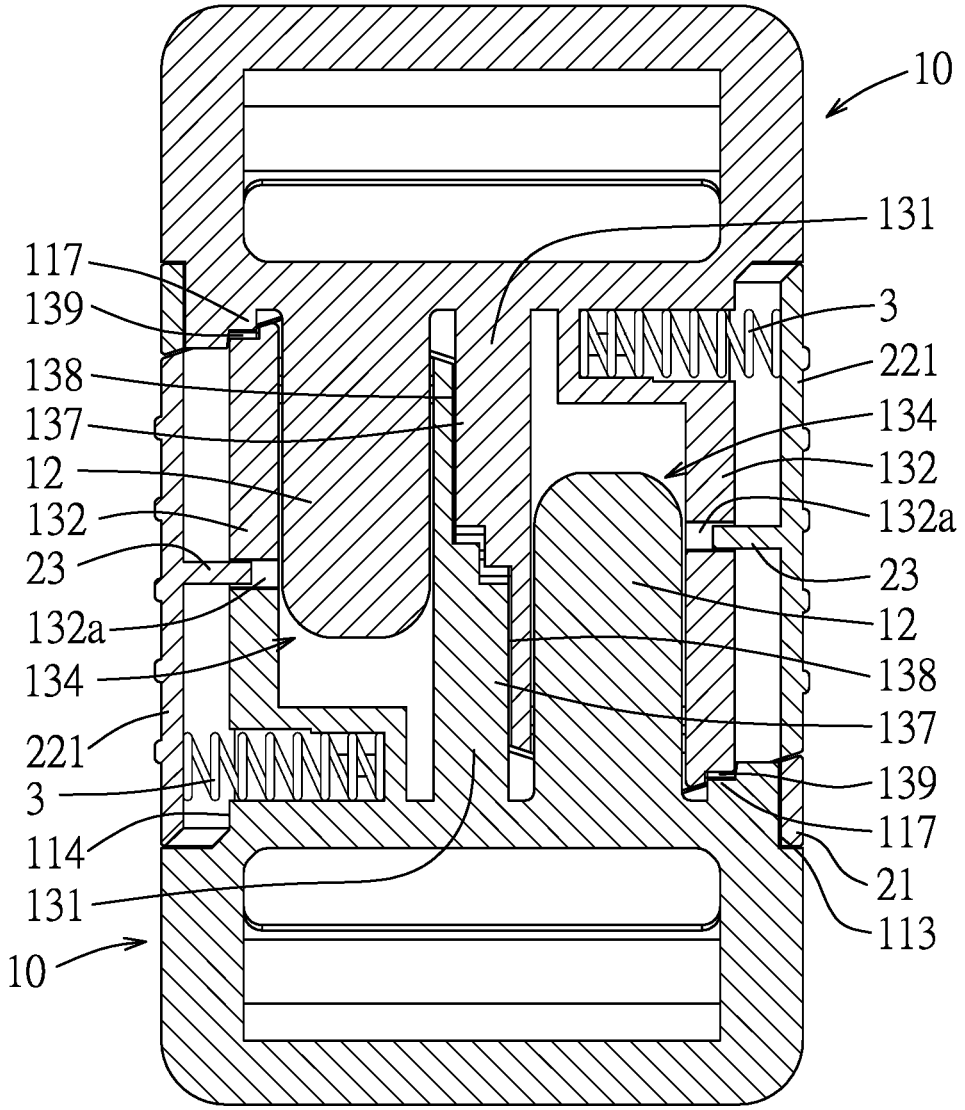
FIG. 8 is a sectional view of the embodiment.
Figure 9:
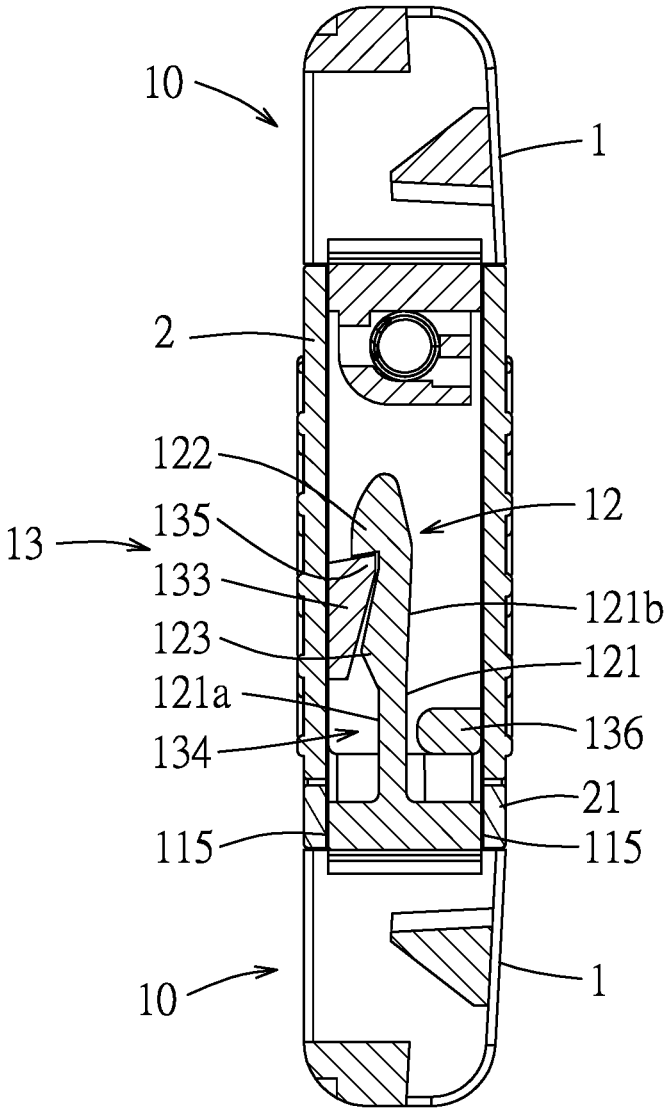
FIG. 9 is another sectional view of the embodiment.

Referring to FIGS. 7 to 9, the coupling modules 10 are coupled separably to each other. The hook member 12 of each of the coupling modules 10 is coupled with the coupling member 13 of the other one of the coupling modules 10. Specifically, the hook member 12 of each of the coupling modules 10 is disposed removably between the connecting wall 133 and the limiting wall 136 of the other one of the coupling modules 10, extends into the coupling groove 134 of the other one of the coupling modules 10, with the hook portion 122 being engaged with the retaining portion 135 of the other one of the coupling modules 10. The hook portion 122 and the abutting block 123 of the hook member 12 of each of the coupling modules 10 cooperatively define a hook space that corresponds in shape to and receives therein the retaining portion 135 of the coupling member 13 of the other one of the coupling modules 10. The inner walls 131 of the coupling members 13 of the coupling modules 10 abut against each other, with the guiding groove 138 of each of the coupling modules 10 engaged separably with the guiding rib 137 of the other one of the coupling modules 10 to position the coupling modules 10 relative to each other such that the hook members 12 of the coupling modules 10 can couple respectively with the coupling members 13 of the coupling modules 10. The positioning rib 117 of each of the coupling modules 10 is engaged separably with the positioning groove 139 of the other one of the coupling modules 10 to ensure that the coupling modules 10 do not rotate relative to each other about an axis which is transverse to the length direction (L). The end surfaces 222*a* of the extending walls 222 of the operating portion 22 of the operating member 2 of each of the coupling modules 10 are in contact with the other one of the half surface parts of the end surrounding surface of the surrounding portion 21 of the operating member 2 of the other one of the coupling modules 10.

Figure 10:
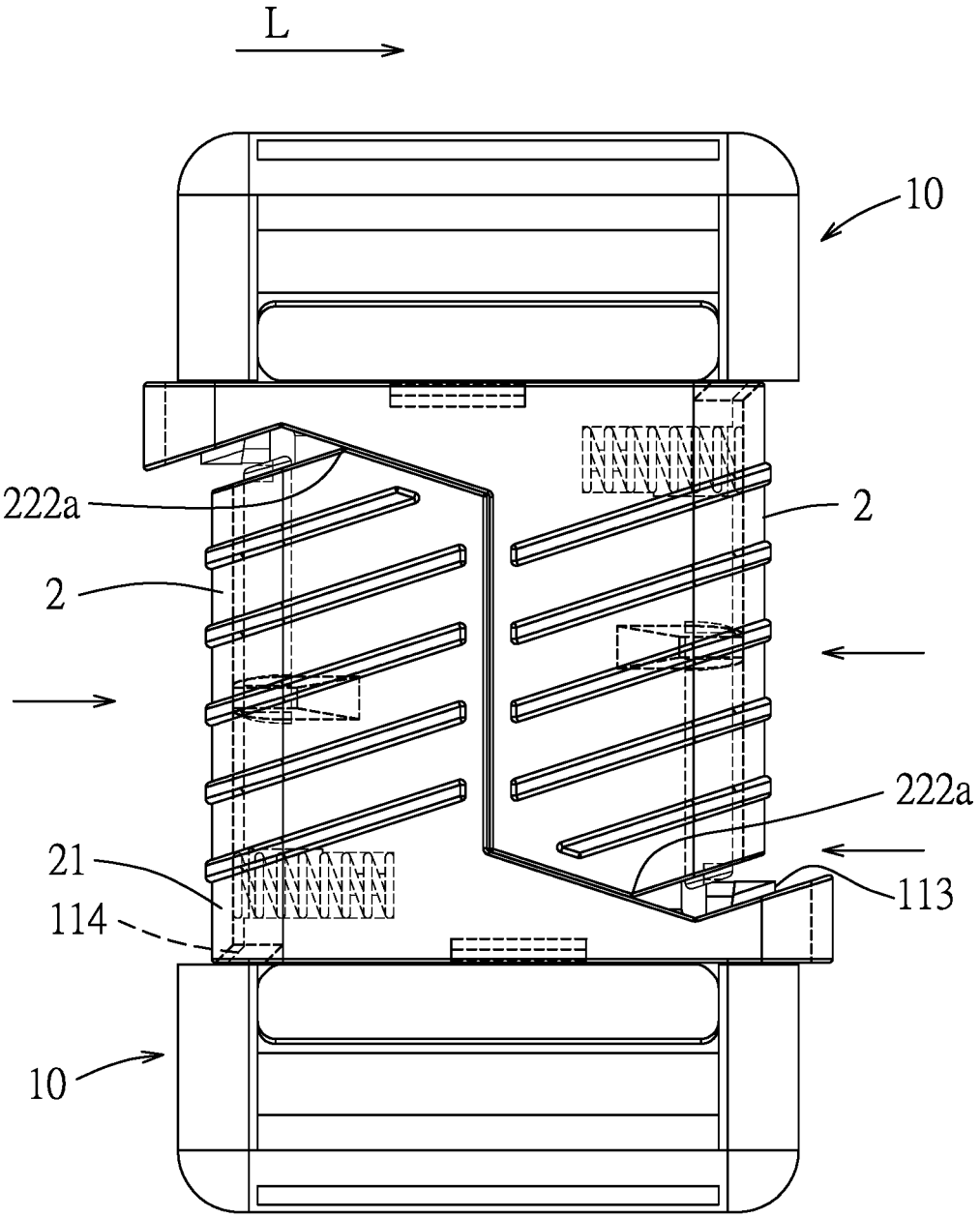
FIG. 10 is a side view of the embodiment, illustrating the operating portions in an unlocked state.

The operating portions 22 of the operating members 2 of the coupling modules 10 are movable substantially parallel to the length direction (L) toward each other relative to the main units 1 of the coupling modules 10 against resilient forces of the resilient members 3 of the coupling modules 10 from a standby state (see FIG. 7) to an unlocked state (see FIG. 10), during which the pushing portion 23 of the operating member 2 of each of the coupling modules 10 pushes the hook member 12 of the main unit 1 of the other one of the coupling modules 10 to disengage the hook member 12 from the retaining portion 135 of the coupling member 13 of the main unit 1 of the coupling module 10, thereby permitting separation of the coupling modules 10 from each other. To operate the operating portions 22 of the operating members 2 to separate the coupling modules 10 from each other, a user may, for example, place a thumb and an index finger of the same hand on the press walls 221 of the operating members 2, respectively, and squeeze to bring the operating members 2 toward each other.

For each of the coupling modules 10, the surrounding portion 21 abuts against the first short surface 113 and the long surfaces 115 and is spaced apart from the second short surface 114 when the operating portions 22 of the operating members 2 are in the standby state, and abuts against the second short surface 114 and is spaced apart from the first short surface 113 when the operating portions 22 of the operating members 2 are in the unlocked state. Referring back to FIG. 2, each of the limiting blocks 24 has a length in the length direction (L) that is shorter than that of each of the limiting grooves 116 so as to be movable along the limiting groove 116 during the movement of the operating portions 22 of the operating members 2 between the standby state and the unlocked state.

The end surfaces 222*a* of the extending walls 222 of the operating portion 22 of the operating member 2 of each of the coupling modules 10 slides along the other one of the half surface parts of the end surrounding surface of the surrounding portion 21 of the operating member 2 of the other one of the coupling modules 10 during the movement of the operating portions 22 of the operating members 2 between the standby state and the unlocked state. In this embodiment, the end surfaces 222*a* and the other ones of the half surface parts of the surrounding portion 21 of the operating members 2 are inclined relative to the length direction (L) such that, during movement of the operating portions 22 of the operating members 2 from the standby state to the unlocked state, the operating members 2 moves slightly and respectively in opposite directions transverse to the length direction (L) away from each other. This allows easier separation of the coupling modules 10 when the operating portions 22 of the operating members 2 are in the unlocked state.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A buckle comprising two coupling modules coupled separably to each other, each of said coupling modules including:

a main unit that includes a base seat being elongated in a length direction and having a seat portion, a hook member connected to said seat portion of said base seat, and a coupling member connected to said seat portion of said base seat and having a coupling groove and a retaining portion, said hook member and said coupling member being spaced apart in the length direction, said hook member of each of said coupling modules extending into said coupling groove of the other one of said coupling modules and being engaged with said retaining portion of the other one of said coupling modules;

an operating member that is connected removably to said main unit and that has an operating portion that is adjacent to said coupling member of said main unit, and a pushing portion that is adjacent to said retaining portion of said coupling member; and a resilient member that is connected between said main unit and said operating member;

wherein said operating portions of said operating members of said coupling modules are movable substantially parallel to the length direction toward each other relative to said main units of said coupling modules against resilient forces of said resilient members of said coupling modules from a standby state to an unlocked state, during which said pushing portion of said operating member of each of said coupling modules pushes said hook member of said main unit of the other one of said coupling modules to disengage said hook member from said retaining portion of said coupling member of said main unit of said coupling module, thereby permitting separation of said coupling modules from each other.

2. The buckle as claimed in claim 1, wherein, for each of said coupling modules, said coupling member of said main unit further has:

an inner wall and an outer wall extending from said seat portion of the base seat, being transverse to the length direction and being respectively proximal to and distal from said hook member; and a connecting wall interconnecting said inner wall and said outer wall, being spaced apart from said seat portion of said base seat, and cooperating with said inner and outer walls to define said coupling groove, said connecting wall having an end that faces said seat portion of the base seat and that serves as said retaining portion of said coupling member.

3. The buckle as claimed in claim 2, wherein:

for each of said coupling modules, said coupling member further has a guiding rib and a guiding groove that are respectively proximal to and distal from said seat portion of said base seat, said guiding rib protruding from a side surface of said inner wall which faces said hook member, said guiding groove being formed in said side surface of said inner wall, being collinear with said guiding rib, and extending through an end surface of said inner wall which is opposite to said seat portion; and said guiding groove of each of said coupling modules being engaged separably with said guiding rib of the other one of said coupling modules.

4. The buckle as claimed in claim 3, wherein, for each of said coupling modules, said guiding rib has an end connected to said seat portion of said base seat and an opposite end being adjacent to said guiding groove.

5. The buckle as claimed in claim 3, wherein, for each of said coupling modules:

said coupling member further has a positioning groove formed in said outer wall; and said base seat further has a positioning rib protruding from said seat portion, disposed at a side of said hook member which is opposite to said coupling member in the length direction, and engaging separably with said positioning groove of the other one of said coupling modules.

6. The buckle as claimed in claim 2, wherein, for each of said coupling module, said outer wall is formed with a passage, said pushing portion of said operating member protruding from an inner surface of said operating portion of said operating member and movably extending into said passage.

7. The buckle as claimed in claim 2, wherein, for each of said coupling modules:

said seat portion of said base seat has first and second short surfaces opposite in the length direction and two opposite long surfaces interconnecting said first and second short surfaces, said first and second short surfaces being respectively proximal to said hook member and said coupling member, each of said long surfaces being formed with a limiting groove that extends in the length direction; and said operating member further has a surrounding portion connected to said operating portion and surrounding said seat portion of said base seat, and two limiting blocks engaging respectively and slidably said limiting grooves of said base seat, said surrounding portion abutting against said first short surface and said long surfaces and being spaced apart from said second short surface when said operating portions of said operating members of said coupling modules are in the standby state, each of said limiting blocks having a length in the length direction that is shorter than that of each of said limiting grooves so as to be movable along said limiting groove during the movement of said operating portions of said operating members of said coupling modules between the standby state and the unlocked state.

8. The buckle as claimed in claim 7, wherein, for each of said coupling modules, said operating portion of said operating member has a press wall that is aligned with said outer wall of said coupling member in the length direction, and two extending walls that respectively extend from two opposite edges of said press wall, and that cover said inner wall, said connecting wall and said coupling groove of said coupling member.

9. The buckle as claimed in claim 8, wherein:

for each of said coupling modules, a length of said surrounding portion of said operating member in the length direction is larger than that of said operating portion, said surrounding portion having an end surrounding surface that surrounds said seat portion of said base seat, said end surrounding surface having two U-shaped half surface parts, one of said half surface parts being connected to said operating portion, the other one of said half surface parts being indented; and for each of said coupling modules, each of said extending walls of said operating portion of said operating member has an end surface that is opposite to said surrounding portion, that is in contact with the other one of said half surface parts of said end surrounding surface of said surrounding portion of said operating member of the other one of said coupling modules, and that slides along the other one of said half surface parts of said end surrounding surface of said surrounding portion of said operating member of the other one of said coupling modules during the movement of said operating portions of said operating members of said coupling modules between the standby state and the unlocked state.

10. The buckle as claimed in claim 2, wherein:

for each of said coupling modules, said hook member has an elastic arm extending from said seat portion of said base seat and having opposite first and second arm surfaces, a hook portion connected to an end portion of said elastic arm that is distal from said seat portion of said base seat, protruding from said first arm surface, and engaging said retaining portion of said coupling member of the other one of said coupling modules when said operating members of said coupling modules are in the standby state, and an abutting block protruding from said first arm surface;

for each of said coupling modules, said coupling member further has a limiting wall interconnecting said inner wall and said outer wall, said connecting wall being disposed between said limiting wall and said seat portion of said base seat; and said hook member of each of said coupling modules is disposed removably between said connecting wall and said limiting wall of the other one of said coupling modules.

11. The buckle as claimed in claim 2, wherein, for each of said coupling modules, said coupling member further has a receiving portion connected to said seat portion of said base seat and said outer wall, and cooperating with said outer wall to define a receiving space that receives said resilient member.

* * * * *